United States Patent [19]

Smeed et al.

[11] Patent Number: 4,619,278

[45] Date of Patent: Oct. 28, 1986

[54] SMOKING ROD WRAPPER

[75] Inventors: Clement G. Smeed, Eire; Shane C. Browning, Newtownabbey, both of Ireland

[73] Assignee: Gallaher Limited, Great Britain

[21] Appl. No.: 575,265

[22] Filed: Jan. 30, 1984

[30] Foreign Application Priority Data

Jan. 31, 1983 [GB] United Kingdom ..... 8302594

[51] Int. Cl.[4] ..... A24B 15/28; A24C 5/60

[52] U.S. Cl. ..... 131/284; 131/331; 131/334; 131/335; 131/365

[58] Field of Search ..... 334/71.1; 101/350, 181; 131/335, 284, 84 R, 285, 334, 331, 365, 84.1

[56] References Cited

U.S. PATENT DOCUMENTS

| | | | |
|---|---|---|---|
| 3,730,086 | 5/1973 | Dauterman | 101/350 |
| 4,236,532 | 12/1980 | Schweizer et al. | 131/335 |
| 4,366,542 | 12/1982 | Anselrode | 101/181 |
| 4,452,140 | 6/1984 | Isherwood et al. | 101/181 |

FOREIGN PATENT DOCUMENTS

| | | |
|---|---|---|
| 2021558 | 7/1970 | France . |
| 2383786 | 10/1978 | France . |
| 1111007 | 4/1968 | United Kingdom . |
| 1235692 | 6/1971 | United Kingdom . |
| 1281371 | 7/1972 | United Kingdom . |
| 2007078 | 5/1979 | United Kingdom . |
| 1600058 | 10/1981 | United Kingdom . |

*Primary Examiner*—V. Millin

*Attorney, Agent, or Firm*—Andrus, Sceales, Starke & Sawall

[57] ABSTRACT

A cigarette rod wrapper is cut from a paper web which is preprinted on its outer surface firstly with brand legend (33) and longitudinally spaced registration markings (32), and then on its inner face with a profiled deposit (34) of an additive such as a nicotine component. The registration markings (32) are used both to ensure longitudinal registration of the printed deposit (34), and in the rod making machine to ensure that the tobacco rod is cut at the correct position. The registration marking (32) is covered in use by a tipping wrapper (43) which unites the tobacco rod with a filter element (42).

21 Claims, 5 Drawing Figures

SMOKING ROD WRAPPER

The invention relates to wrappers for cylindrical smoking rods, such as cigarettes and cigarillos, comprising a combustible tubular wrapper, usually made of paper or a tobacco based material, surrounding a combustible filler of tobacco and/or tobacco substitute.

It has previously been proposed to improve the burning characteristics, or to improve the satisfaction to the smoker, of such smoking rods by applying to the wrapper an additive, e.g. a burn control agent, a smoke producing agent, a smoke nucleation agent, a flavouring agent, and/or a physiologically active agent, such agent affecting the burn rate of the wrapper and/or affecting, or being released into, the main stream smoke, upon approach of the burning tip of the rod. We are particularly interested in the release into the main stream smoke of a nicotine component to enhance the satisfaction of a low tar cigarette. However, little practical consideration has been given to the manner in which such agents can satisfactorily be applied to the smoking rod wrapper.

For example, GB-A-1111077 discloses a smoking rod wrapper which is uniformly impregnated with a nicotine component. However this leads to a puff by puff increase in the nicotine concentration in the main stream smoke, owing to the continual condensing of the volatile components in the main stream smoke as it is cooled upon approaching the buccal end of the smoking rod.

To overcome this problem, it has been appreciated that it would be desirable to deposit the additive on the wrapper in a predetermined pattern which results in uniform, or a modified profile for the, puff by puff smoking qualities. Thus in our GB-B-2007078, we disclose screen printing on the inner surface of a smoking rod wrapper of a series of dots of an ink containing an additive such as a nicotine component, the printing being in a predetermined pattern such that the nicotine component loading decreases along the wrapper from the lit to the buccal end of the smoking rod. This earlier specification did not address the problem of how such wrapper could be used on a high speed cigarette making machine from a preprinted web of wrapper material, whilst ensuring that the printed deposit would be in the correct position along each cigarette. An advantage of dots or discontinuous coating is that the flexibility of the wrapper is maintained. An incidental advantage of profile printing is that the wrapper porosity changes a smaller amount as the product is smoked because the printed dot areas are less pervious than unprinted wrapper.

GB-A-1235692 discloses the printing of a smoking rod wrapper with a burn accelerating agent in a predetermined pattern and suggests that the printing could be incorporated into the process of manufacture of the smoking rod as an additional stage during the feeding of the continuous wrapper web into the rod forming section of a continuous rod making machine. This would alleviate the problem of correct positioning of the printed deposit along each smoking rod length into which the continuous rod is subsequently to be cut, provided that the printing station and rod cutting knife were synchronized and by means of a conventional advance and retard mechanism and adequate compensation were made for stretch of the wrapper between the printing and cutting stations. However this is not a practical solution as we are concerned not with the printing of the minimum quantity of an ink necessary for visible legend, but the deposit of a much higher loading of an additive. Such quantities of additive require a significant volume of carrier liquid, which is preferably evaporated prior to the wrapper being curled to encircle the filler in the rod-making machine. At the speed at which a modern rod-making machine operates, the printing and evaporation of the solvent on line with the rod making, would require an unacceptably long machine. A further disadvantage of printing on the rod forming machine is that liquid toxic material has to be used on the rod making machine or in the making area, thereby introducing health and safety problems and requiring special precautions.

In accordance with the present invention, in a method of processing a web of smoking rod wrapper, the web is passed through initial and final printing stations in series, and then reeled up for subsequent use on a continuous tobacco rod-making machine; the web being printed at the initial printing station on one surface with a regularly longitudinally spaced registration marking, and being printed at the final printing station and on its other surface with a repetitive regularly spaced pattern of a deposit containing an additive which is arranged to improve the smoking qualitites of the resulting smoking rod.

The width of the printed deposit will usually be less than the width of the wrapper used on the tobacco rod-making machine so as to allow a normal adhesive lap seam to be formed on the rod-making machine.

A wrapper web produced in this way is then substantially ready for unreeling and use on a continuous rod-making machine, in which case the surface of the wrapper on which the registration marking is printed will be used on the outside, where the registration marking is clearly visible, and the printed deposit will be on the inside of the wrapper, where it is hidden from touch and view. The rod-making machine will then incorporate a sensor which recognises the passing of the registration marking to control the phase and frequency of the knife which cuts the smoking rod into sections or by similarly controlling the paper drive. This will ensure that the printed deposit incorporating the additive will be positioned correctly in the subsequent individual smoking rods.

The registration marking may consist of the conventional printed legend or so called 'monogram' on the outer surface of a smoking rod, representing the make or brand, and which is normally printed on line by the rod-making machine. In this case of course it will be preprinted. However it is unusual for such legend to be sufficiently bold or to have a sufficiently well defined leading edge for reliable recognition by an optical sensor and the registration marking is preferably bold printing in the form for example of a dot or transverse bar. Also the pitch of the legend on a filter tip cigarette alternates short and long, adding up to two tobacco rod lengths, so as to suit the tipping machine used after the tobacco rod-making machine. Since the registration marking will be on the external surface of the wrapper, and may well be unsightly, in the case of a smoking rod with a filter tip connected to the tobacco rod by a conventional simulated cork wrapper, the registration marking is preferably arranged to be positioned immediately adjacent to the filter tip, and hence covered by the overlap of the simulated cork wrapper. This hides the marking from view in finished smoking rod product but if, by chance, the marking becomes visible on the outer surface of the product, it is immediately apparent to the operator of the rod-making machine that registration has failed, and hence that the hidden printed deposit on the inner surface of the wrapper is wrongly positioned along the individual smoking rods. The machine must then be stopped and the fault corrected. Normally this correction would be part of the paper speed control and rejection of faulty cigarettes would be automatic using an extra reject input to the normal nucleonic cigarette weight control reject system.

Conventional legend may be printed on the one surface of the wrapper web simultaneously with the registration marking. However if different colours are required, there may be two of the initial printing stations, one for printing the registration marking and the other for printing the conventional legend. This is a convenient place to print the legend since at this stage the wrapper web is still essentially flat and accurate fine printing can be carried out. Also it is preferable to do all printing before the coating of additive deposit is applied to avoid, after coating and in line with the coating, a printing roller nip on the incompletely dry and discontinuous coating. By contrast, if the legend were printed in the conventional manner on line by the rod-making machine, the non-uniform projection of the heavy additive-containing deposit on the other surface of the wrapper web would make adequate support of the web for fine printing difficult. Also the monogram printer on the rod-making machine would have to be synchronised with the pre-printed registration marks.

The initial printing station or stations and the final printing station must be sufficiently spaced for the printed registration marking and printed legend on the one surface of the wrapper web to dry, either naturally or assisted by a drier, before the additive-containing deposit is printed on the other surface of the wrapper web. This spacing may typically amount to 5 m. and, if the wrapper web is pulled through the printing stations, the web may stretch to an indeterminate extent before it reaches the final printing station, resulting in slight inaccuracies in the positioning of the additive-containing deposit relatively to the registration marking. This is particularly serious if the wrapper web is for use in making back to back filter tip cigarette or other smoking rods, in which case if the pattern of printed deposit applied in the final printing station extends across two smoking rod lengths, any inaccuracy in position will lead to significant differences between the effects of the additive in adjacent smoking rods cut from the same double rod length. In order to overcome this problem, the registration marking may be used for registration of the wrapper web with the final printing station. This would be achieved by providing a sensor, particularly an optical sensor, adjacent to the final printing station and responsive to the registration marking printed in the initial printing station, and controlling an advance and retard mechanism for the final printing station accordingly. The registration marking then has the synergistic function both of controlling the accurate printing of the additive-containing deposit relatively to the registration marking, and subsequently in the rod-making machine of controlling the position of the additive-containing deposit relatively to the individual cut rod lengths.

The additive-containing deposit may be applied in the final printing station by a screen or gravure printing process and the amount of wet deposit may be sensed by for example an infrared monitor past which the web is drawn. The liquid carrier for the additive will need to be evaporated before the web is handled further and the web is preferably passed through a drier. The dry additive-containing deposit may then be checked by for example a capacitance monitor which senses changes in capacitance between electrodes due to the deposit on a strip of the moving web and senses variations in the deposit according to the desired pattern of deposit. A novel feature is that the repetitive patterns of deposit may be measured relatively to the unprinted web between patterns and hence the pattern profile sensed.

The printed wrapper web may be reeled up on a driven reel positioned downstream of final nip rollers which are at least part of the means by which the web is drawn through the printing drying and inspection stations. As previously mentioned, the heavy additive-containing deposit projects nonuniformly from the surface of the wrapper web and this can cause problems when the web is reeled up. Normally a flat web would be reeled up under constant tension. However as the radius of the reel grows upon reeling up, the radially inward layers of reeled web become more highly compressed radially and the circumferential tension descreases. In the case of the present web, with its heavy discontinuous deposit on one surface, this can cause loss of tension and crumpling of the inner layers, making it difficult to use the web in these layers, making it difficult to use the web in these layers subsequently in slitting and in a continuous rod-making machine. According to an independent aspect of the invention therefore a wrapper web, having on at least one surface a heavy discontinuous deposit is reeled up on a reel which is rotated under substantially constant torque.

The substantially constant torque may be provided by a constant torque electric motor. The substantially constant torque ensures that the tension, as the outer layer is wound on, actually decreases as the radius of the reel increases as a result of the laid layers of web, and this helps to compensate for the compression problem.

For convenience, when the wrapper web is being printed, it will have a width corresponding to a multiple, for example between twelve and twenty-five, individual smoking rod wrapper widths. In such case, the final nip pull-through roller on the coated surface of the web is then preferably relieved in line with the longitudinal lines of deposit. The reeled web will then be processed on a conventional slitter to divide the reel into narrower reels of web of individual smoking rod wrapper widths, for use on a continuous rod-making machine.

The invention also includes a printing machine for producing a printed wrapper web as described, the machine comprising means for passing a wrapper web through the machine from an unwind reel adjacent to one end of the machine in turn through one or more of the initial printing stations, the final printing station, a drier station, to a rewind reel, preferably at the other end of the machine. The final printing station may be positioned adjacent to the one end of the machine, and the or each initial printing station located to the side of the final printing station adjacent to the other end of the machine, with the drier station extending substantially along the full length of the machine.

This particular layout has the benefit that, immediately after passing through the final printing station, at which the heavy wet additive containing deposit is printed on the web, the web can be guided by appropriate rollers engaging only the one face of its sheet on which the now dry registration marking has been printed, through the drier station which extends for the maximum distance along the length of the machine with minimum changes of direction during which the still wet deposit might be disturbed.

The drier station preferably incorporates a housing through which the web is drawn, the housing containing nozzles which direct hot air against the wet deposit on the web. This provides a rapid but low temperature drying effect, which is particularly important if the deposit contains an additive which is susceptible to high temperature.

If the substantially dry deposit is to be monitored using a capacitance monitor as previously mentioned, it is important that the capacitance monitor sensor is situated extremely closely to the adjacent moving web and it is important that at this point the web is extremely flat without any creases or flapping, which could bring the sensor into damaging contact with the web, or affect the response of the sensor.

This difficulty is overcome by a further independent feature of the invention, according to which a discontinuous deposit on a web of material is monitored by moving the web past a stationary capacitance monitor having a sensor located immediately adjacent but spaced from one surface of the web; the other surface of the web being supported opposite to the sensor by a primary support and being supported upstream and downstream of the primary support by secondary supports, the arrangement being such that the plane of the web is deflected through a small angle in the same sense as it passes over each of the three supports.

This arrangement ensures only light contact or flotation between the web and the supports and serves to smooth out any wrinkles in, or flapping of, the web. The small angle may be less than 5° at the primary support. The primary support may be a smooth plate, preferably with air flotation to reduce and provide cooling, and the secondary supports may be rollers to and from which the web is led over further rollers.

In a convenient arrangement in which the web has been printed with multiple parallel tracks of the deposit, it may be desirable to provide more than one of the sensors. In practice we find it is appropriate to provide one sensor on a track adjacent to each edge of the web and one or two sensors on tracks adjacent to the centre of the web. In order to provide accurate alignment transversely of the web between each sensor and the track to be sensed, the sensors are preferably mounted on a bar which has a fixed gap relative to the primary support and overlies the web, the sensors being arranged to be moved to and fro with the bar and to be fixed in a selected position on the bar.

It is also advantageous continuously to monitor the pitch of the registration marks for cyclical or long term variations. Preferably this can be done using two optical sensors on one or more tracks spaced at the nominal pitch together with appropriate timing electronics. These sensors can conveniently be mounted adjacent to or on the capacitance monitor. Variations in pitch can be very troublesome at the subsequent rod making stage.

Visual inspection of the surface of the moving web on which the additive-containing deposit has been printed, is desirable prior to reeling up. In a normal printing or other web handling machine, the web is normally passed up and down and to and fro over rollers or other guides which extend transversely to the length of the machine. However this is inconvenient for visual inspection of the web since the operator has to be in line with the machine to inspect the web and then it is only convenient to do so at one or other end of the machine, where the unwind and rewind reels are situated.

In accordance with a further independent feature of the invention, a machine for producing a printed wrapper web comprises means for passing the web from an unwind reel to a rewind reel through the machine and at least through one printing station via web guide surfaces extending transversely to a nominal length of the machine; wherein at least one air turner bar is provided for intercepting the web and deflecting the web onto at least two guide surfaces extending parallel to the nominal length of the machine, and between which the web passes with its plane facing laterally of the machine for visual inspection.

After visual inspection the web may be wound onto a rewind reel the axis of which extends parallel to the nominal length of the machine, but preferably a second air turner bar is used to bring the web back onto support surfaces extending transversely of the nominal length of the machine.

In a convenient configuration, two air turner bars are provided, one above the other, with their axes inclined at 45° to the nominal length of the machine. A horizontal run of the web is intercepted by one bar and turns the web so that it moves laterally to a side of the machine from whence it passes over a roller having its axis extending parallel to the length of the machine. From thence the web passes in a substantially vertical plane along the visual inspection path before passing around a second roller having its axis parallel to the length of the machine and hence into the machine and around the second air turner bar back onto a further horizontal path along the web contreline of the machine. This arrangement enables visual inspection of the web by an operator standing at the side of the machine and is particularly useful for inspecting the heavy deposit of an additive-containing printed pattern. The air turner bars have the advantage that they provide minimum resistance to the web, which is being drawn over them, and there is no direct contact between the web and bar.

Conveniently, when a capacitance monitor for deposit level is used as described, the monitor may be provided overlying the web at the lateral visual inspection point.

A machine for producing a wrapper web in accordance with the invention, and the resulting product and its use are illustrated diagramatically in the accompanying drawings, in which.

Figure 1:
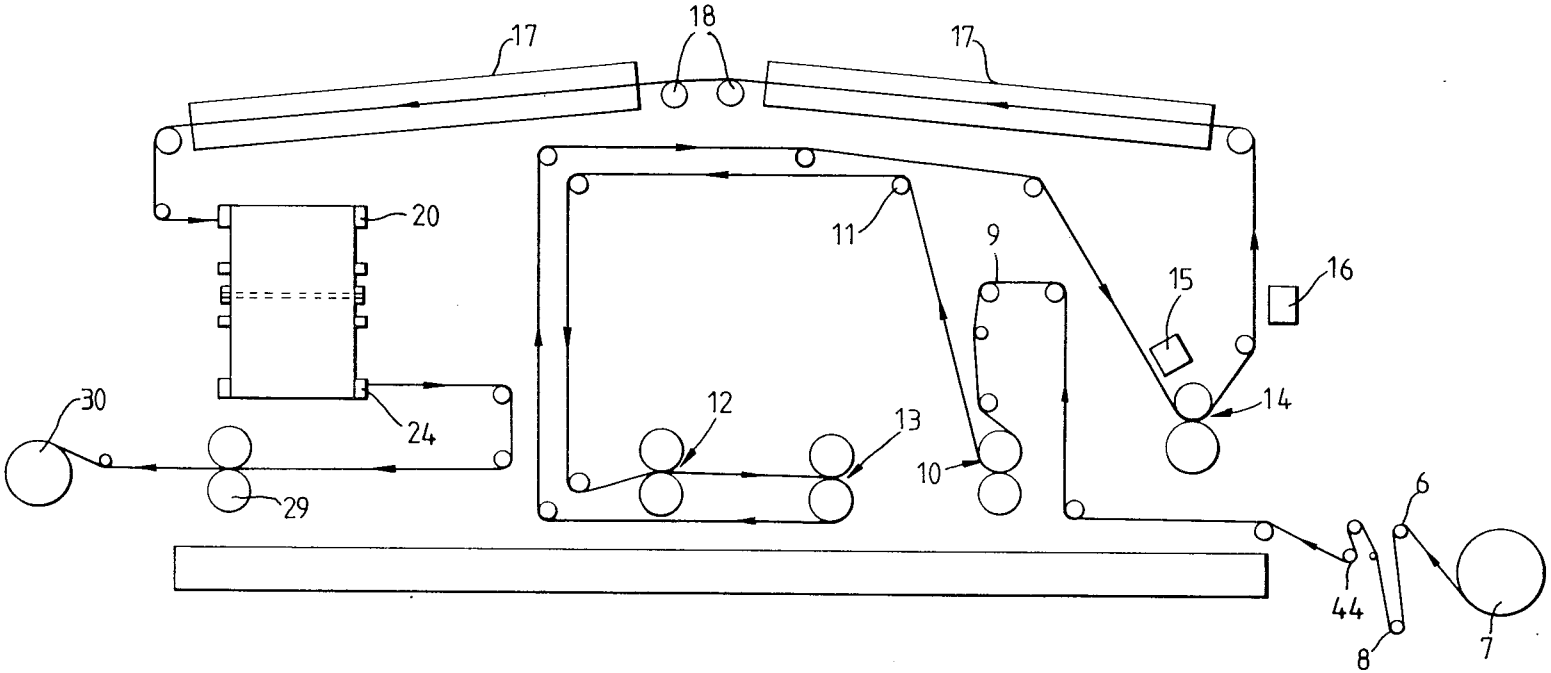
FIG. 1 is a side elevation showing schematically the path of the web through the machine.

As shown in FIG. 1, a paper web 6 is drawn through the machine from an unwind reel 7, which is provided with an automatic brake to provide constant tension in the web, around a dancing roller 8, a web length coding disc 44 and through an infeed tracking 9 which centralizes the web transversely and infeed 10. Throughout its passage through the machine, the web is entrained around a number of transversely extending rollers 11, only one of which is specifically indicated in FIG. 1, but the purpose of all of which is clearly apparent from the drawing. From the infeed unit 10, the web 6 passes through first and second initial printing stations 12 and 13 at which one (the top) face of the web is printed with brand legend or monogram, and with transverse bar registration markings, respectively. The printing is carried out in multiple parallel tracks, as will subsequently be explained with respect to FIG. 4. The web then passes through a final printing or coating station 14 where the other (lower) face of the web is printed with a repetitive pattern of dots containing an additive, such as a nicotine component. The printing in the station 14 is brought into register with the printing carried out in the stations 12 and 13 by optical recognition of the registration marking by means of a sensor 15. The sensor controls a conventional advance and retard mechanism at the station 14.

The loading of the wet deposit printed on the web in the station 14 is monitored by means of an infrared monitor 16. Thereafter the web passes with the web coating uppermost through a hot air drier having two sections 17 in the form of an inverted shallow V, between which the web passes over guide rollers 18. This arrangement reduces flutter of the web within the drier.

Figure 2:
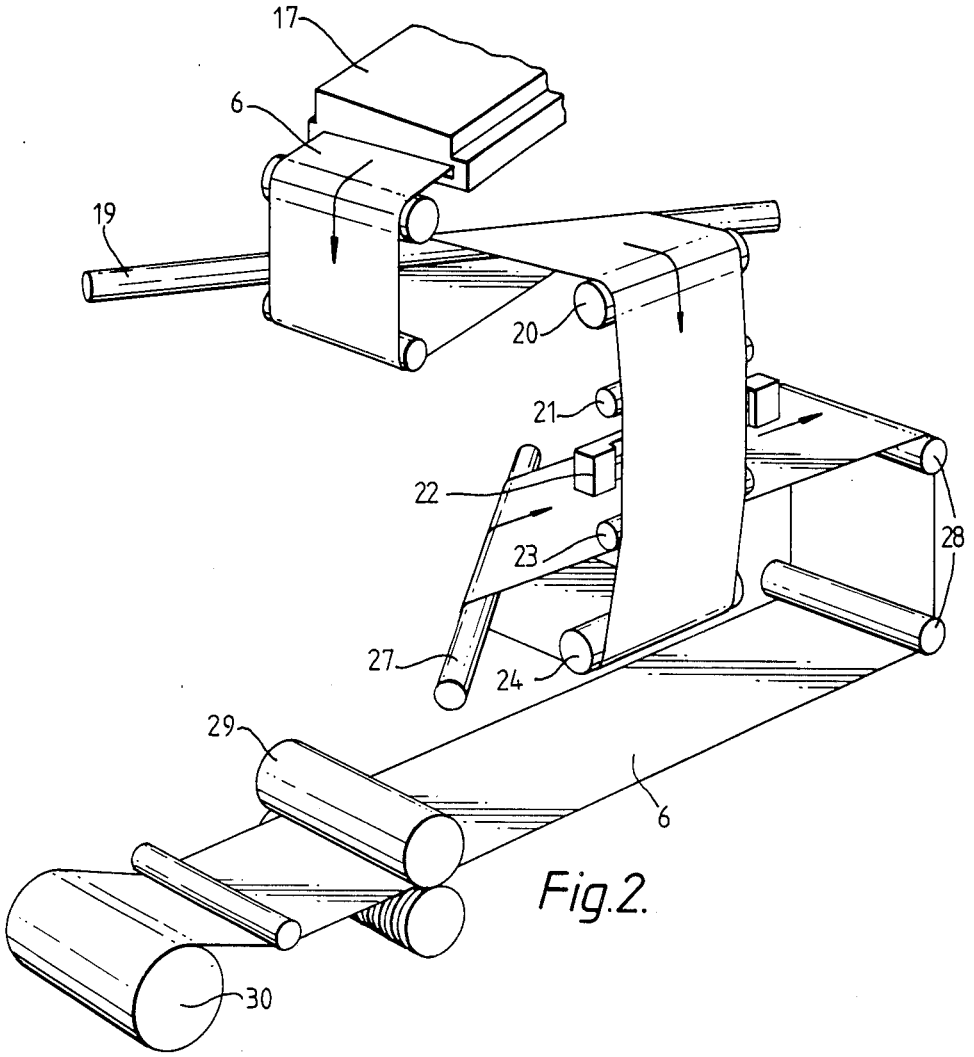
FIG. 2 is an isometric view showing an inspection point on the machine.
Figure 3:
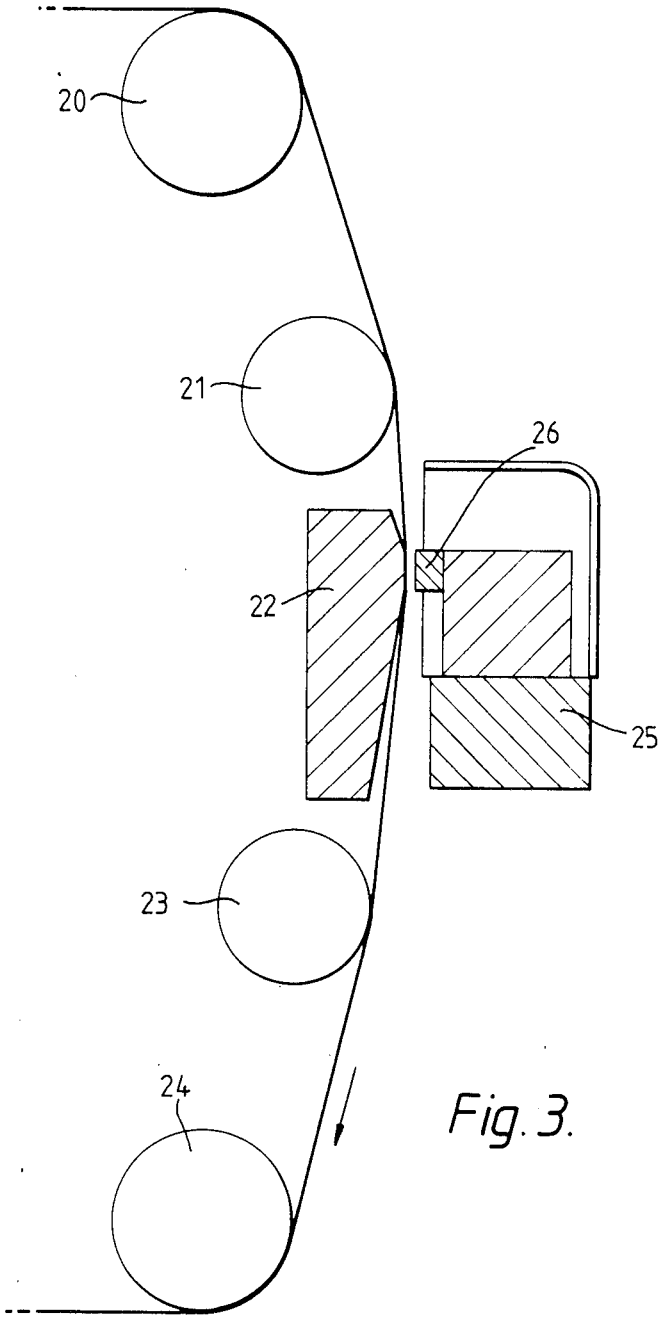
FIG. 3 is a vertical cross section through part of the inspection point.

After leaving the drier, and as shown in FIG. 2, the web is turned by means of an inclined air turner bar 19 and brought to one side of the machine where it passes downwards through an inspection point. As shown in FIGS. 2 and 3, the web passes over a first roller 20, a second roller 21, a smooth primary support 22, a third roller 23, and a fourth roller 24. The rollers 21 and 23 form secondary supports and as the web passes over the rollers 21 and 23, and over the primary support 22, it is turned through a small angle of say up to 5°. Opposite to the primary support 22 is a support bar 25, which has been omitted from FIG. 2 for reasons of clarity, and which supports a number of transversely spaced capacitance monitors 26. As the web passes between the support 22 and the monitors 26, the corresponding tracks of the deposited additive are sensed and the output from the monitors 26 is presented visually so that the loading of the deposit, as compared to the unprinted web, between the longitudinally spaced additive deposits, is readily available. Furthermore, the exposed outer face of the web, for example where it passes between the rollers 20 and 21, that is to say the face of the web bearing the additive deposit, is exposed for visual inspection by an operator standing to the side of the machine.

After passing through the inspection point, the web passes around a further stationary air turner bar 27 which brings the direction of movement of the web back into the longitudinal direction of the machine. Thereafter the web passes over rollers 28 of a further tracking guide for transverse centralisation. The web is essentially drawn through the machine by a pair of nip rollers 29, the lower one of which engages the surface of the web on which the additive deposit has been printed, and is relieved annularly so as only to engage the web between the printed tracks. The web is then wound up on a rewind roll 30 which is driven at constant torque by a constant torque electric motor.

Figure 4:
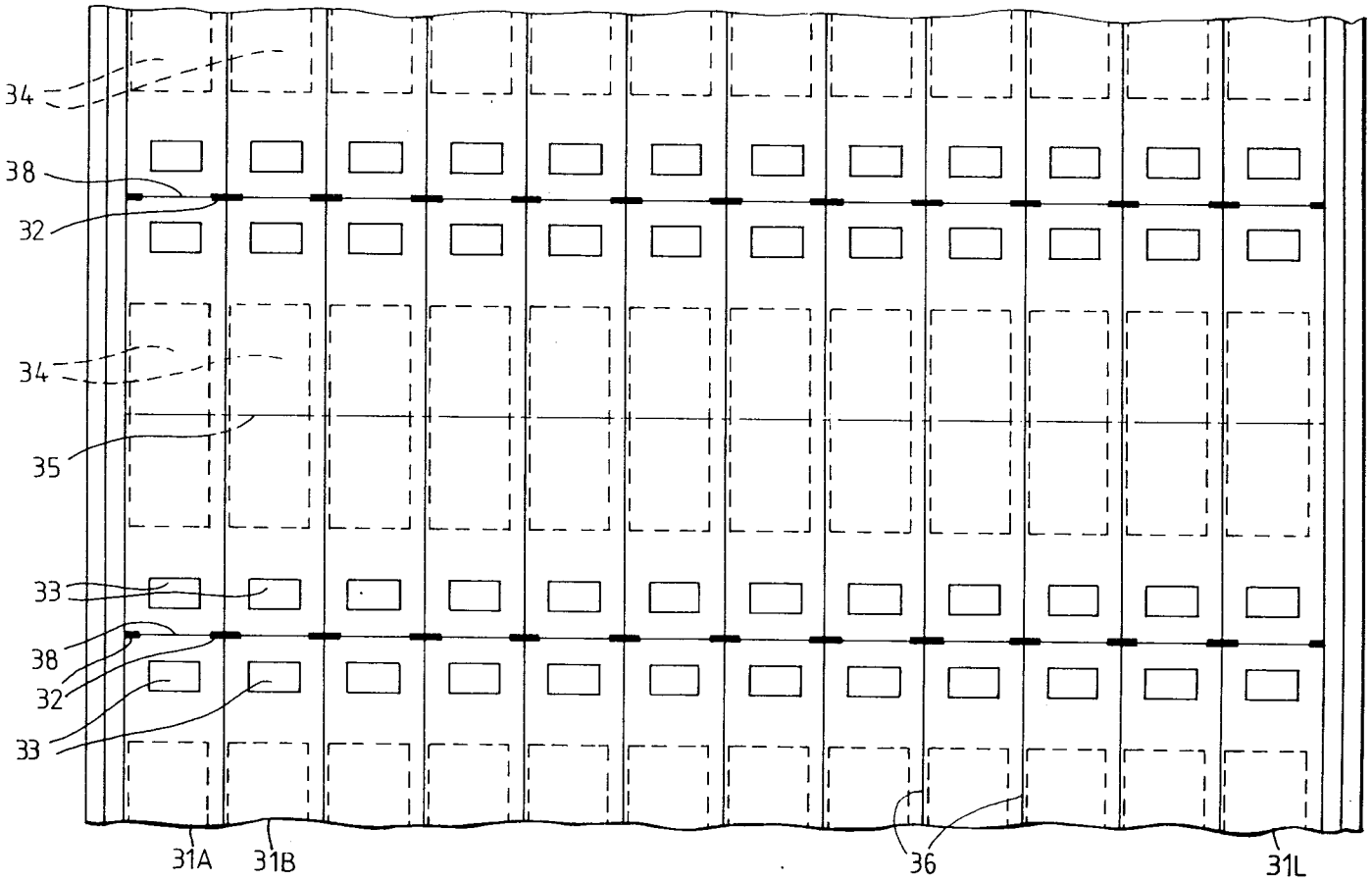
FIG. 4 is a plan of part of a wrapper web produced on the machine.

As shown in FIG. 4, the web has, in this case, twelve parallel printed tracks 31A, 31B . . . 31L. One surface of the web is printed with the transverse bar registration markings 32, and with the brand legend or monogram 33. The other surface of the web is printed with the dots of additive coating in the areas 34. If the additive comprises, e.g. a nicotine component, the concentration of the dots decreases longitudinally of the web in both directions away from a transverse centre line 35. After reeling on the reel 30, the web is subsequently unwound, slit along lines 36, and re-reeled into twelve individual wrapper reels. Each narrow reel is then used on a modified continuous tobacco rod-making machine, in which the exposed bars 32 are sensed and used to control the synchronization of the machine. The rod will be cut at the transverse lines 35 and at the transverse lines 38 for the subsequent insertion of double length filter tips, which are united to the intervening tobacco rods by a conventional tipping wrapper which should cover the half width bars 32. The resulting assemblies are subsequently cut through the centres of the filter tips into individual cigarettes.

Figure 5:
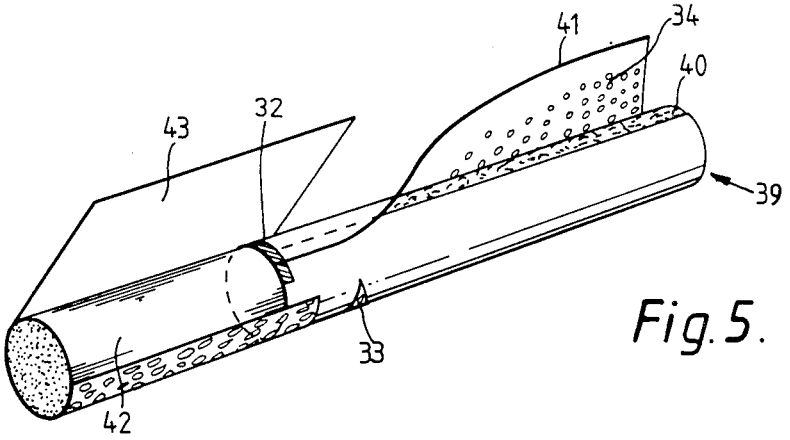
FIG. 5 is a partially exploded view of a filter tip cigarette incorporating part of the wrapper web of FIG. 4.

A typical cigarette is shown in FIG. 5. The tobacco rod 39 consists of a conventional filler 40 wrapped in the printed wrapper 41 which bears on its outer surface the half width registration marking 32 and the brand legend 33, and on its inner surface with the concentration of printed dots 34. The concentration profile of which decreases from the lit end of the cigarette towards the buccal end. A filter element 42 abuts the end of the tobacco rod 39 and is united to it by a conventional tipping wrapper 43 which overlaps the tobacco rod 39 and conceals the half width registration marking 32.

We claim:

1. A method of processing a web of smoking rod wrapper suitable for filter tip cigarettes, said web having opposed first and second surfaces, wherein said web is passed through initial and final printing stations in series, and then reeled up for subsequent use on a continuous smoking rod-making machine; said web being printed at said initial printing station on said first surface with a regularly longitudinally spaced registration marking, and being printed at said final printing station and on said second surface with a repetitive regularly spaced pattern of a deposit containing at least one additive selected from a group comprising a burn control agent, a smoke producing agent, a smoke nucleation agent, a flavoring agent, and a physiologically active agent, said pattern being repeated on successive sectional web lengths comprising one or more smoking rod lengths of web, said registration markings being printed at least one end of said sectional lengths and having a dimension in the longitudinal direction of said web such that at least after cutting said web into individual smoking rod lengths, said marking dimension is small enough to be covered by the overlap of a conventionally applied tipping wrapper.

2. A method according to claim 1 wherein said registration marking is printed as bold printing in the form of a dot or a bar transverse to the longitudinal direction of the web.

3. A method according to claim 1 wherein a product identification legend to appear on the outer surface of said smoking rod is also printed on said first surface of said web and between sequential pairs of said registration markings at said initial printing station.

4. A method according to claim 1, wherein said registration marking is used for registration of said wrapper web with said final printing station.

5. A method according to claim 4 wherein said registration of said wrapper web with said final printing station is achieved by sensing said registration marking printed at said initial printing station, and controlling an advance and retard mechanism for said final printing station accordingly.

6. A method according to claim 1, wherein said additive-containing deposit on said web is checked by moving said web past a capacitance monitor which senses changes in capacitance between electrodes owing to said deposit and senses variations in said deposit according to said pattern of said deposit.

7. A method according to claim 1, wherein, after printing, said web is reeled upon a reel which is rotated under substantially constant torque.

8. A method according to claim 1, wherein said additive is a nicotine component.

9. A method according to claim 1, wherein said deposit pattern provides a concentration gradient along individual smoking rod lengths of said web.

10. A method according to claim 1, of processing a web for use as the smoking rod wrapper of filter tip cigarettes, wherein said registration markings are longitudinally spaced along the web at intervals corresponding to two smoking rod lengths, and said additive component-containing deposit is printed over an area symmetrically positioned between each adjacent pair of said longitudinally spaced registration markings.

11. A method according to claim 10 wherein a product identification legend to appear on the outer surface of said smoking rod is also printed on said first surface of said web at said initial printing station, and between the end of each deposit area and an adjacent one of said registration markings.

12. A method according to claim 10, wherein said printing of said deposit pattern provides for a concentration of said additive in said area decreasing in both directions along said web from a position mid-way between said adjacent pair of registration markings.

13. A printing machine for processing a web of smoking rod wrapper, said web having opposed first and second surfaces, said machine comprising an unwind wheel adjacent to a first end of said machine; initial and final printing stations in series; means for passing said web through said initial and final printing stations, said initial printing station being adapted to print on said first surface of said web a regularly longitudinally spaced registration marking, and said printing station being adapted to print on said second surface of said web a repetitive regularly spaced pattern of a deposit containing at least one additive selected from the group comprising a burn control agent, a smoke producing agent, a smoke nucleation agent, a flavouring agent and a physiologically active agent; a rewind wheel adjacent to a second end of said machine for reeling up said web for subsequent use on a continuous smoking rod-making machine; and a drier station extending substantially along the full length of said machine; said initial printing station being located to the side of said final printing station nearer to said second end of said machine.

14. A machine according to claim 13, wherein said drier comprises a housing containing nozzles adapted to direct hot air against a wet deposit on said web.

15. A machine according to claim 13, wherein said drier comprises at least two sections in the form of an inverted shallow V, and said means for passing said web through said machine comprises rollers upstream, downstream and between said drier sections whereby said web is adapted to be passed through said drier sections by entrainment over said rollers with said second surface of said web uppermost.

16. A machine according to claim 13, further comprising a stationary capacitance monitor having a sensor located immediately adjacent but spaced from one surface of said moving web; and, for supporting the opposed surface of said web, a primary support opposite said sensor and secondary supports upstream and downstream of said primary support; the arrangement being such that the plane of said web is deflected through a small angle in the same sense as said web passes over each of said primary and secondary supports.

17. A machine according to claim 13, wherein means for passing said web through said machine comprises web guide surfaces extending transversely to the length of said machine; and wherein at least one air turner bar is provided for intercepting said web and deflecting said web onto at least two guide surfaces extending parallel to the nominal length of said machine, and between which guide surfaces said web passes with its plane facing laterally of said machine for visual inspection of said second surface of said web.

18. A filter tip cigarette comprising a smoking rod connected end to end with a filter element by a tipping wrapper which surrounds said filter element and overlaps the adjacent end of said smoking rod, said smoking rod comprising a filler with a tubular wrapper which has printed on the inner surface thereof a pattern of a deposit containing an additive for improving the smoking qualities of said cigarette, and which has printed on the outer surface thereof at the end thereof adjacent to said filter element a registration marking which is covered by the overlap of said tipping wrapper.

19. A cigarette according to claim 18 wherein said additive comprises a nicotine component.

20. A cigarette according to claim 18 wherein the concentration of said deposit printed on said inner surface of said wrapper decreases from the end of said smoking rod remote from said filter element toward said end of said smoking rod adjacent to said filter element.

21. A cigarette according to claim 18 wherein said pattern is a series of dots.

* * * * *